United States Patent [19]

Dodsworth

[11] Patent Number: 4,866,885

[45] Date of Patent: Sep. 19, 1989

[54] ABRASIVE PRODUCT

[76] Inventor: John Dodsworth, 1 Manor Close, Trimdon Village, County Durham, United Kingdom

[21] Appl. No.: 153,229

[22] Filed: Feb. 8, 1988

[30] Foreign Application Priority Data

Feb. 9, 1987 [ZA] South Africa ..... 87/0920
Mar. 5, 1987 [ZA] South Africa ..... 87/1593

[51] Int. Cl.[4] ..... B24D 3/00

[52] U.S. Cl. ..... 51/293; 51/295; 51/303

[58] Field of Search ..... 51/293, 295, 303

[56] References Cited

U.S. PATENT DOCUMENTS 3,343,932 9/1967 Juillerat ..... 51/293
3,868,235 2/1975 Held ..... 51/309
4,662,896 5/1987 Dennis ..... 51/293
4,690,691 9/1987 Komanduri ..... 51/295
4,702,649 10/1987 Komanduri ..... 51/293

*Primary Examiner*—Paul Lieberman
*Assistant Examiner*—Willie J. Thompson
*Attorney, Agent, or Firm*—Scully, Scott, Murphy & Presser

[57] ABSTRACT

A composite abrasive compact is produced by placing strips of suitable abrasive material on a cemented carbide substrate. The strips each comprise abrasive particles, optionally with a particulate second phase, in an organic binder. The organic binder is first removed by volatilization. Then, the cemented carbide substrate with the strips thereon is subjected to compact-producing conditions of elevated temperature and pressure.

16 Claims, 3 Drawing Sheets

FIG. 1
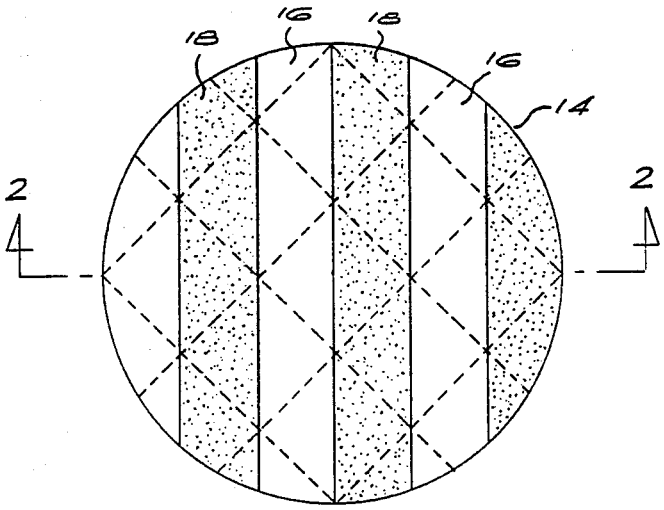
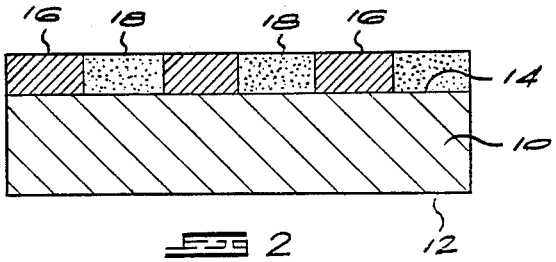
FIG. 2
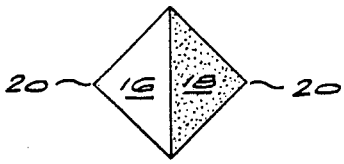
FIG. 3

FIG. 4
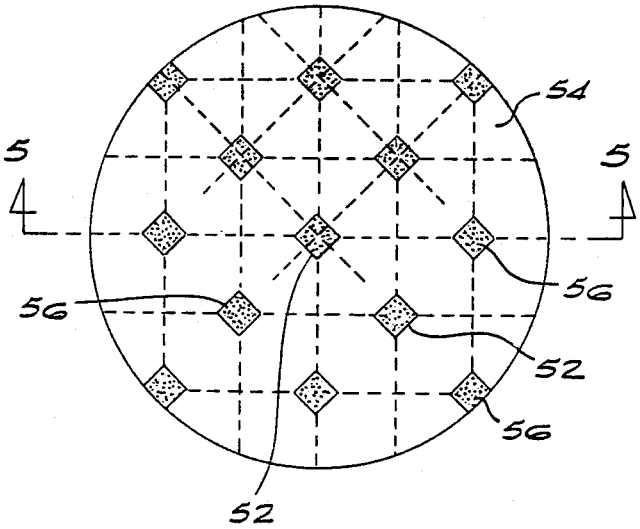
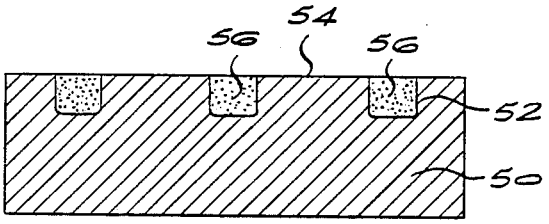
FIG. 5
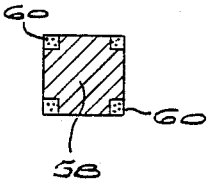
FIG. 6A
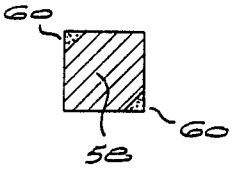
FIG. 6B

FIG. 7
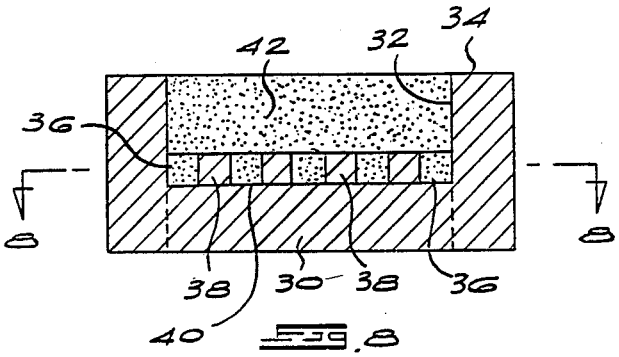
FIG. 8
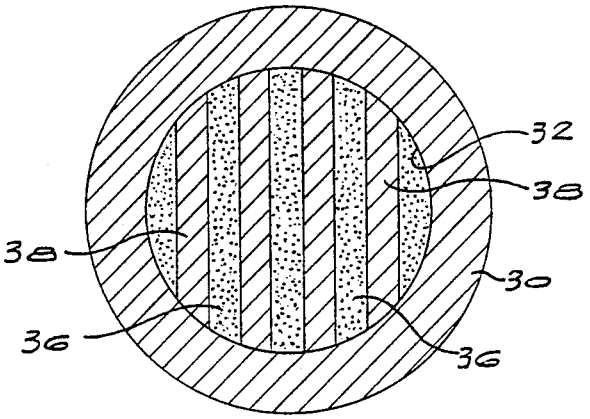
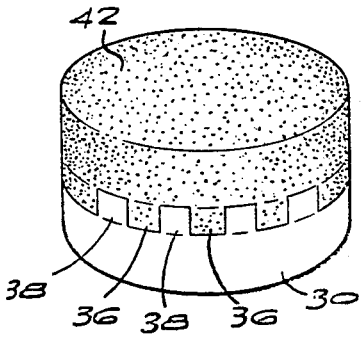
FIG. 9

ABRASIVE PRODUCT

BACKGROUND OF THE INVENTION

This invention relates to abrasive products.

Abrasive compacts are used extensively in cutting, milling, grinding, drilling and other abrasive operations. The abrasive compacts consist of polycrystalline diamond or cubic boron nitride particles bonded into a coherent hard conglomerate. The abrasive particle content of abrasive compacts is high and there is an extensive amount of direct particle-to-particle bonding. Abrasive compacts are made under elevated temperature and pressure conditions at which the abrasive particle, be it diamond or cubic boron nitride, is crystallographically stable.

Abrasive compacts tend to be brittle and in use they are frequently supported by being bonded to a cemented carbide substrate. Such supported abrasive compacts are known in the art as composite abrasive compacts. The composite abrasive compact may be used as such in the working surface of an abrasive tool.

Examples of composite abrasive compacts can be found described in U.S. Pat. Nos. 3,745,623, 3,767,371 and 3,743,489.

Other effective cubic boron nitride abrasive bodies which do not contain as high an abrasive particle content as abrasive compacts are also known and used in the art. Such abrasive bodies generally comprise a sintered body containing 40 to 60 volume percent of cubic boron nitride particles uniformly dispersed in a continuous ceramic bonding matrix. These abrasive bodies are also made under temperature and pressure conditions at which the cubic boron nitride is crystallographically stable. U.S. Pat. No. 4,469,802 describes such a body.

Recently there has been introduced on to the market a composite diamond abrasive compact under the trademark "claw cutter". This cutter has a diamond compact layer on the cemented carbide substrate and in addition a series of grooves formed in the substrate immediately behind the diamond compact layer and containing diamond compact. During use wear of the compact layer occurs and once this wear reaches the grooved zone, so it is said, sharpening occurs enabling a longer and more effective abrasive action to take place.

Composite abrasive compacts are generally produced by placing the components in powdered form, necessary to form an abrasive compact on a cemented carbide substrate. This unbonded assembly is placed in a reaction capsule which is then placed in the reaction zone of a conventional high pressure/high temperature apparatus. The contents of the reaction capsule are subjected to conditions of elevated temperature and pressure at which the abrasive particles are crystallographically stable.

SUMMARY OF THE INVENTION

According to the present invention, there is provided a method of making an abrasive body which comprises a layer of bonded ultra-hard abrasive particles bonded to a substrate, including the steps of:

(i) providing the substrate;

(ii) depositing a layer of the components necessary to form the layer of bonded ultra-hard abrasive particles, in particulate form, in an organic binder on a surface of the substrate; and (iii) subjecting the substrate and layer to conditions of elevated temperature and pressure at which the ultra-hard abrasive particles are crystallographically stable.

DESCRIPTION OF THE DRAWINGS

FIGS. 1 and 2 illustrate schematically one embodiment of the invention;

FIG. 3 illustrates a plan view of an abrasive body produced using the method of FIGS. 1 and 2;

FIGS. 4 and 5 illustrate a second embodiment of the invention;

FIGS. 6A and 6B illustrate plan views of abrasive bodies produced by the method of FIGS. 4 and 5;

FIG. 7 illustrates a sectional side view of another embodiment of the invention;

FIG. 8 illustrates a view along the line 8—8 of FIG. 7; and

FIG. 9 illustrates a perspective view of a composite abrasive compact produced by the method of the invention.

DETAILED DESCRIPTION OF THE INVENTION

The method of the invention is suitable for producing a variety of abrasive bodies, particularly composite abrasive compacts. Essential to the invention is that a layer of the components necessary to form the layer of bonded ultra-hard abrasive particles, in particulate form, in an organic binder is deposited on a surface of the substrate. This enables thin, i.e. less than 0,5 mm in thickness, layers to be formed on the substrate surface. Further, layers of more uniform composition and thickness can be deposited producing composite abrasive compacts and similar such bodies of improved quality. The organic binder binds the particulate components enabling the layer to be deposited on a curved, irregular or other surface. Finally, as will be described more fully hereinafter, composite abrasive compacts of various shapes and characteristics may be conveniently produced using the method of the invention.

The organic binder binds the particulate components and is preferably removed prior to subjecting the substrate and layer of particulate components to the conditions of elevated temperature and pressure. The binder is preferably one which decomposes or volatilizes at a temperature of 300° C. or higher. Examples of suitable binders are cellulose binders and plasticizers. Removal of the binder is preferably achieved by heating the layer of particulate components to cause the binder to decompose or volatilise.

The layer of particulate components may be deposited on the surface of the substrate by suspending the particulate components in a liquid such as water which contains the organic binder dispersed or dissolved therein, depositing that liquid suspension on the surface, e.g. by dipping, spraying or coating and removing the liquid from the suspension. Removal of the liquid, particularly if it is water, will generally be achieved by heating.

The layer of particulate components may also be produced in the form of a coherent, self-supporting layer which is then placed on the surface of the substrate. The coherent, self-supporting layer may be produced by depositing a coating of the particulate components suspended in a liquid which contains the organic binder dissolved or dispersed therein onto a support surface, removing the liquid from the coating, and heating the thus treated coating. The liquid will generally be water and it will typically removed from the coating by heating. After removal of the liquid from the coating, and prior to heating it, it is preferable to compact the coating. Compaction may, for example, be achieved by passing the coating through a set of rollers. The coating in its final, heated form is coherent and self-supporting. It may be produced in thin strip form which may be flexible allowing it to be bent. Further details of the particular steps which can be used in producing the coherent, self-supporting layers are described in British patent specification No. 1,212,681, the contents of which are incorporated herein by reference.

The method of the invention may be used for producing abrasive bodies of a variety of shapes, sizes, compositions and characteristics. The method may, in particular, be used for producing composite abrasive compacts of high quality. For such composite compacts, the particulate components will comprise the ultra-hard abrasive particles alone or in combination with material necessary to produce a second phase. When the ultra-hard abrasive particles are diamond, the particulate components will typically consist of diamond particles alone or in admixture with a particulate metal. When the ultra-hard abrasive particles are cubic boron nitride, the particulate components will typically consist of cubic boron nitride particles and a particulate second phase such as cobalt, aluminium, and an aluminium alloy or a ceramic compound.

The surface of the substrate may be flat, curved or of other shape. The presence of the organic binder enables the layer of particulate components to be applied to surfaces such as curved surfaces which would not normally hold the particulate components. In one particular form of the invention, the substrate presents at least one major flat surface and the layer is deposited on that surface so as to cover it completely. The major flat surface may form one side of a disc-shaped substrate.

The invention also enables alternate strips of different materials to be formed on the substrate surface. For example, a plurality of coherent, self-supporting layers in strip form may be produced in the manner described above, the strips placed on the major flat surface of a substrate in spaced relationship and a material suitable to produce a bonded abrasive layer less abrasive than the layers of bonded ultra-hard abrasive particles may be placed in the spaces between the adjacent strips. Alternatively, two sets of strips can be produced and placed on the surface, such that the strips of one set alternate with the strips of the other set.

The substrate will generally be a cemented carbide substrate. A preferred cemented carbide is a cobalt cemented tungsten carbide.

The conditions of elevated temperature and pressure which are used in the method of invention are typically a pressure in the range of 50–70 kilobars and a temperature in the range 1450°–1600° C. Typically, these elevated conditions are maintained for a period of 10–30 minutes.

Embodiments of the invention will now be described. A plurality of strips of abrasive particles bonded by means of a cellulose binder were produced by suspending the abrasive particles in water in which the cellulose was dissolved. The suspension was deposited on a surface and the water removed by heating. This produced a coating with some coherency. The coating was passed through rollers to compact it and then heated to produce a self-supporting strip. The two sets of strips were used —each set containing a different abrasive particle.

These strips were then placed on a surface of a cemented carbide body in the manner illustrated by FIGS. 1 and 2. Referring to these Figures, there is shown a disc-shaped cemented carbide body 10, which has major flat surfaces 12,14 on opposite sides thereof. A plurality of the strips 16,18 were placed on the surface 14. The strips 16 were from the one set whereas the strips 18 were from the other set. The carbide disc on which the strips had been placed were then heated to a temperature of above 300° C. to volatilize the cellulose binder. Thereafter, the disc was placed in a reaction capsule and the capsule placed in the reaction zone of a conventional high temperature/high pressure apparatus. The contents of the capsule were subjected to a temperature of 1500° C. and a pressure of 55 kilobars. These conditions were maintained for a period of 15 minutes. This sintering caused the strips 16,18 to form effective layers of bonded abrasive which layers were bonded to each other and to the carbide body 10. The body was recovered from the reaction capsule using conventional techniques.

The body was cut or severed along planes indicated by the dotted lines on FIG. 1. This had the effect of producing diamond-shaped abrasive bodies of the type illustrated by FIG. 3. It will be noted that each body has two separate layers of different material bonded to the carbide backing, each layer providing a cutting point 20. Thus, for example, the layer 16 may be of diamond compact while the layer 18 may be of cubic boron nitride compact. A variety of different combinations may be used producing versatile abrasive bodies, each having cutting points or edges of different abrasive properties. The difference in abrasive properties can also be achieved by using the same abrasive particles, bit of different size, in each layer. The abrasive bodies of FIG. 3 may be utilised as inserts in a variety of abrasive tools.

A second embodiment is illustrated by FIGS. 4 and 5. FIG. 5 is a section along the line 5—5 of FIG. 4. A disc-shaped cemented carbide body 50 has a plurality of diamond-shaped recesses 52 formed in the flat surface 54 thereof. Each recess is filled with a layer of abrasive particles in an organic binder such as cellulose. The binder was removed by heating. The cemented carbide body was then placed in the reaction zone of a conventional high temperature and high pressure apparatus in the manner described above and subjected to the same high temperature/high pressure conditions. The body recovered from the apparatus was severed along the planes indicated by the dotted lines in FIG. 4. Such severing had the effect of producing a plurality of square abrasive bodies of the type illustrated by FIGS. **6*A* or 6*B* depending on how the severing took place. Each abrasive body had a cemented carbide core 58 and abrasive cutting corners 60**. The abrasive cutting corners may be of the same material or of different material.

Another embodiment of the invention will now be described with reference to FIGS. 7 to 9. A body 30 of cemented carbide had a circular, in plan, recess 32 formed in one major flat surface 34. Alternate strips of abrasive material 36 and other material 38 were placed across the base surface 40 of the recess. Adjacent strips are contiguous with their neighbours and are spaced evenly across the base surface, as illustrated particularly by FIG. 2. Each strip was coherent and self-supporting and produced in the manner described above with reference to the embodiment of FIGS. 1 and 2. The abrasive material were diamonds alone or a mixture of diamond particles and cobalt powder. The other material was a mixture of carbide particles and cobalt powder.

The strips were heated to remove the organic binder. Thereafter a layer 42 of diamond particles was placed on the strips 36,38. The diamonds of the strips were larger than the diamonds of the layer 42. In this manner the recess 32 was completely filled. The loaded disc 30 was placed in a reaction capsule and this capsule placed in the reaction zone of a conventional high temperature/high pressure apparatus. The contents of the capsule were subjected to a pressure of 55 kilobars and simultanously a temperature of 1500° C. and these elevated conditions are maintained for a period of 15 minutes. This resulted in the diamond layer 42 forming a diamond compact bonded to the strips 36,38 which in turn were bonded to the cemented carbide disc. The material of the layers 36 formed diamond compact which was bonded on each side to its neighbors.

The product was removed from the reaction capsule and the sides of the disc removed, as illustrated by dotted lines in FIG. 1. After removal of the sides, the resulting product was as illustrated by FIG. 3. It will be noted from this FIGURE that the diamond compact layer 42 has, in effect, a series of grooves 36 containing further diamond compact material located immediately behind it. The product is thus of a groove cutter type.

I claim:

1. A method according to the layer of particulate components is deposited on the surface of the substrate by suspending the particulate components in a liquid containing the organic binder dispersed or dissolved therein, depositing liquid suspension on the surface and removing the liquid from the suspension.

2. A method according to claim 1 wherein the liquid is water.

3. A method according to claim 2 wherein the liquid is removed from the suspension by heating.

4. A method according to claim 1 wherein the layer of particulate components is a coherent, self-supporting layer which is pre-formed and then placed on the surface of the substrate.

5. A method of making an abrasive body which comprises a layer of bonded ultra-hard abrasive particles bonded to a substrate, including the steps of:

(i) providing the substrate;

(ii) depositing a layer of the components necessary to form the layer of bonded ultra-hard abrasive particles, in particulate form, in an organic binder on a surface of the substrate; and (iii) subjecting the substrate and layer to conditions of elevated temperature and pressure at which the ultra-hard abrasive particle is crystallographically stable wherein the layer of particulate components is a coherent, self-supporting layer which is preformed and then placed on the surface of the substrate, the coherent, self-supporting layer being produced by depositing a coating of the particulate components suspended in a liquid which contains the organic binder dissolved or dispersed therein on to a support surface, removing the liquid from the coating, and heating the thus treated coating.

6. A method according to claim 5 wherein the liquid is water.

7. A method according to claim 6 wherein the liquid is removed by heating.

8. A method according to claim 5 wherein the coating, after the liquid has been removed and prior to the heating, is compacted.

9. A method of making an abrasive body which comprises a layer of bonded ultra-hard abrasive particles bonded to a substrate, including the steps of:

(i) providing the substrate;

(ii) depositing a layer of the components necessary to form the layer of bonded ultra-hard abrasive particles, in particulate form, in an organic binder on a surface of the substrate; and (iii) subjecting the substrate and layer to conditions of elevated temperature and pressure at which the ultrahard abrasive particle is crystallographically stable wherein the organic binder is a cellulose derivative

10. A method according to claim 9 wherein the cellulose derivative decomposes at a temperature of 300° C. or higher.

11. A method according to claim 1 wherein the substrate presents at least one major flat surface and the layer is deposited on that surface so as to cover it completely.

12. A method according to claim 1 wherein the substrate presents at lease one major flat surface, a plurality of coherent, selfsupporting layers of the particulate components, in strip form, are provided, the strips are placed on the major flat surface in spaced relationship and a material suitable to produce a bonded abrasive layer less abrasive than the layers of bonded ultra-hard abrasive particles is placed in the spaces between adjacent strips.

13. A method according to claim 1 wherein the substrate has a recess having side walls and a base formed therein and the layer is deposited in the recess so as to cover the base and at least part of the side walls.

14. A method according to claim 1 wherein the substrate is cemented carbide substrate.

15. A method according to claim 1 wherein the layer of bonded ultra-hard abrasive particles has a second phase uniformly distributed through the bonded particles.

16. A method of making an abrasive body which comprises a layer of bonded ultra-hard abrasive particles bonded to a substrate, including the steps of:

(i) providing the substrate;

(ii) depositing a layer of the components necessary to form the layer of bonded ultra-hard abrasive particles, in particulate form, in an organic binder on a surface of the substrate; and (iii) subjecting the substrate and layer to conditions of elevated temperature and pressure at which the ultra-hard abrasive particle is crystallographically stable.

wherein the organic binder is removed from the layer of particulate components prior to step (iii).

* * * * *

UNITED STATES PATENT AND TRADEMARK OFFICE

CERTIFICATE OF CORRECTION

PATENT NO. : 4,866,885

DATED : September 19, 1989

INVENTOR(S) : John Dodsworth

It is certified that error appears in the above-identified patent and that said Letters Patent is hereby corrected as shown below:

Column 5, line 29, Claim 1: delete "according to" and insert the following: --of making an abrasive body which comprises a layer of bonded ultra-hard abrasive particles bonded to a substrate, including the steps of:

(i) providing the substrate;

(ii) depositing a layer of the components necessary to form the layer of bonded ultra-hard abrasive particles, in particulate form, in an organic binder on a surface of the substrate; and (iii) subjecting the substrate and layer to conditions of elevated temperature and pressure at which the ultra-hard abrasive particle is crystallographically stable wherein--

Column 5, line 33, Claim 1: after "depositing" insert --the--

UNITED STATES PATENT AND TRADEMARK OFFICE

CERTIFICATE OF CORRECTION

PATENT NO. : 4,866,885

DATED : September 19, 1989

INVENTOR(S) : John Dodsworth

It is certified that error appears in the above-identified patent and that said Letters Patent is hereby corrected as shown below:

Cancel Claim 4.

Column 6, line 26, Claim 11: after "1" insert --or 5--

Column 6, line 30, Claim 12: after "1" insert --or 5--

Column 6, line 39, Claim 13: after "1" insert --or 5--

Column 6, line 43, Claim 14: after "1" insert --or 5--

Column 6, line 45, Claim 15: after "1" insert --or 5--

Signed and Sealed this

Sixth Day of April, 1993

*Attest:*

STEPHEN G. KUNIN

*Attesting Officer*

*Acting Commissioner of Patents and Trademarks*